US010865357B2

(12) United States Patent
Hutchison

(10) Patent No.: US 10,865,357 B2
(45) Date of Patent: Dec. 15, 2020

(54) LUBRICATING OIL COMPOSITION WITH IMPROVED OXIDATION RETENTION AND REDUCED SLUDGE AND VARNISH FORMATION

(71) Applicant: PHILLIPS 66 COMPANY, Houston, TX (US)

(72) Inventor: Gregory S. Hutchison, Broken Arrow, OK (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 15/875,284

(22) Filed: Jan. 19, 2018

(65) Prior Publication Data

US 2018/0208867 A1 Jul. 26, 2018

Related U.S. Application Data

(60) Provisional application No. 62/449,196, filed on Jan. 23, 2017.

(51) Int. Cl.

| | |
|---|---|
| ***C10M 133/44*** | (2006.01) |
| ***C10M 101/00*** | (2006.01) |
| ***C10M 169/04*** | (2006.01) |
| ***C10M 133/02*** | (2006.01) |
| *C10M 133/12* | (2006.01) |
| *C10N 30/06* | (2006.01) |
| *C10N 30/08* | (2006.01) |
| *C10N 30/10* | (2006.01) |
| *C10N 30/12* | (2006.01) |
| *C10N 40/00* | (2006.01) |

(52) U.S. Cl.

CPC ..... *C10M 133/44* (2013.01); *C10M 101/00* (2013.01); *C10M 133/02* (2013.01); *C10M 169/04* (2013.01); *C10M 133/12* (2013.01); *C10M 2203/003* (2013.01); *C10M 2203/1025* (2013.01); *C10M 2205/028* (2013.01); *C10M 2205/0285* (2013.01); *C10M 2215/065* (2013.01); *C10M 2215/223* (2013.01); *C10M 2215/26* (2013.01); *C10M 2215/30* (2013.01); *C10N 2030/06* (2013.01); *C10N 2030/08* (2013.01); *C10N 2030/10* (2013.01); *C10N 2030/12* (2013.01); *C10N 2040/135* (2020.05)

(58) Field of Classification Search

CPC ..... C10M 2215/26; C10M 2215/30; C10M 2203/003; C10N 2240/14; C10N 2230/12; C10N 2020/055; C10N 2030/18

See application file for complete search history.

(56) References Cited

U.S. PATENT DOCUMENTS

| | | | | |
|---|---|---|---|---|
| 4,115,343 | A * | 9/1978 | Guillaume | C10M 171/004 508/214 |
| 6,083,889 | A | 7/2000 | Angelo et al. | |
| 6,180,575 | B1 | 1/2001 | Nipe | |
| 6,207,623 | B1 | 3/2001 | Butler et al. | |
| 6,410,490 | B1 | 5/2002 | Reyes-Gavilan et al. | |
| 8,227,391 | B2 | 7/2012 | Ryan et al. | |
| 2010/0099589 | A1* | 4/2010 | Ryan | C10M 141/06 508/280 |
| 2013/0017982 | A1 | 1/2013 | Ikai | |

* cited by examiner

*Primary Examiner* — Vishal V Vasisth

(74) *Attorney, Agent, or Firm* — Phillips 66 Company

(57) ABSTRACT

A composition comprising: an oil of lubricating viscosity; an alkylated phenyl-α-naphthyl amine; and at least one oil soluble triazole or derivatives thereof. Wherein the oil soluble triazole or derivatives thereof comprises at least one oil soluble diphenylamine tolutriazole reaction product.

6 Claims, No Drawings

LUBRICATING OIL COMPOSITION WITH IMPROVED OXIDATION RETENTION AND REDUCED SLUDGE AND VARNISH FORMATION

CROSS-REFERENCE TO RELATED APPLICATIONS

This application is a Non-Provisional application which claims the benefit of and priority to U.S. Provisional Application Ser. No. 62/449,196 filed Jan. 23, 2017 entitled "Lubricating Oil Composition with Improved Oxidation Retention and Reduced Sludge and Varnish Formation," which is hereby incorporated by reference in its entirety.

STATEMENT REGARDING FEDERALLY SPONSORED RESEARCH OR DEVELOPMENT

None.

FIELD OF THE INVENTION

This invention relates to a lubricating oil composition that can be used for numerous lubricant applications.

BACKGROUND OF THE INVENTION

Lubricating oil compositions are generally composed of a majority of base oil plus a variety of additives to impart desirable properties. Lubricants are typically used to separate moving parts in systems.

A turbine is a device that generally uses lubricants to separate the moving parts that generate electricity or mechanical power through rotational movement of a shaft. Gas and steam turbines use a flow of hot combustion gas or steam to generate energy in the form of thrust and/or shaft power, in any combination.

Gas, steam and combined cycle power generation units are often operated in extreme environments and exposed to changes in atmospheric pressure, changes in ambient temperature, water, sea water, dust, and a host of other liquid and solid contaminants. Sludge and other deposits are particularly undesirable in power generation units used in a peak-load or cyclic manner. In such circumstances, the turbine will be activated and put into service for relatively short periods of time to meet peak loads on the electrical grid. Once the demand softens, the units are shut down and the oil stops circulating. Sludge and other deposits are more likely to settle out of the oil composition as the oil cools down to ambient temperature. The problem is aggravated by repetition of this heating-cooling process and also probably the stagnation of the oil.

A number of tests are known to determine the oxidative stability of lubricating compositions. The most common are ASTM D2272—Rotary Pressure Vessel Oxidation Test ("RPVOT") and ASTM D943—Turbine Oil Stability Test ("TOST"). The fact that a particular antioxidant package performs well in these oxidative screening test, however, does not necessarily guarantee that it will be effective to control sludge and other deposits. A more stringent test is the "MHPS Dry-TOST" as described in Mitsubishi Hitachi Power System MS04-MA-CL001, MS04-MA-CL002, MS04-MA-CL005, and MS04-MA-CL006 specifications; the Dry-TOST is also described by American Society for Testing and Materials standard test method D-7873. The Dry-TOST test evaluates an oil compositions ability to resist oxidation and the potential for deposit formation due to the composition.

Thus, there is a need for lubricant compositions having excellent oxidative stability and minimal deposit and sludge formation.

BRIEF SUMMARY OF THE DISCLOSURE

The present embodiment describes a composition comprising an oil of lubricating viscosity; an alkylated phenyl-α-naphthyl amine; and at least one oil soluble triazole. In this embodiment, the oil soluble triazole comprises at least one oil soluble diphenylamine tolutriazole reaction product.

In an alternate embodiment, the composition comprises an oil of lubricating viscosity; an alkylated phenyl-α-naphthyl amine; and an oil soluble diphenylamine tolutriazole reaction product. In this embodiment, the alkylated phenyl-α-naphthyl amine has an alkyl group from about 8 to about 12 carbon atoms and being present in an amount from about 0.1 wt % to about 0.7 wt %. Also in this embodiment, the oil soluble diphenylamine tolutriazole reaction product is present in the amount from about 0.05 wt % to about 0.5 wt %.

BRIEF DESCRIPTION OF THE DRAWINGS

A more complete understanding of the present invention and benefits thereof may be acquired by referring to the follow description taken in conjunction with the accompanying drawings in which:

None

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiments describe a lubricant composition that can be used for numerous lubricant applications such as: turbines, compressors, gear oils, gearbox, hydraulics, or even pistons. In one embodiment, the composition comprises an oil of lubricating viscosity; an alkylated phenyl-α-naphthyl amine; and at least one oil soluble triazole. In this embodiment, the oil soluble triazole comprises at least one oil soluble diphenylamine tolutriazole reaction product.

The oil of lubricating viscosity can be any known base oil. The base oils, also referred to as base stocks, may comprise any of the conventional oils encompassed by API Groups I-V. The base stocks in Group I contain less than 90% saturates and/or have a sulfur content greater than 0.03%, and have a viscosity index of at least 80, but less than 120. The base stocks in Group II have at least 90% saturates, no more than 0.03% sulfur, and a viscosity index of at least 80, but less than 120. Group III base stocks have similar characteristics to Group II base stocks, except that Group III base stocks have higher viscosity indexes (i.e., a viscosity index>120). Group III base stocks are produced by further hydrocracking of Group II base stocks, or of hydroisomerized slack wax, (a byproduct of the dewaxing process).

In some embodiments, the oil of lubricating viscosity can be a combination of base stocks. The combinations can include at least two different types of a group of base stocks, such as at least two Group I base stocks, at least two Group II base stocks, at least two Group III base stocks, at least two Group IV base stocks or at least two Group V base stocks. In other combinations, the oil of lubricating viscosity can be at least two different types of base stocks, such as a Group I base stock with at least one Group II base stock or at least one Group III base stock or at least one Group IV base stock or at least one Group V base stock.

In one embodiment, mineral oil base stocks are used such as for example conventional and solvent-refined paraffinic neutrals and bright stocks, hydrotreated paraffinic neutrals and bright stocks, naphthenic oils, cylinder oils, and so forth, including straight run and blended oils. In one more particular embodiment, synthetic base stocks can be used such as, for example, blends of poly alpha-olefins with synthetic diesters in weight proportions (poly alpha-olefin:ester) ranging from about 95:5 to about 50:50.

Base stock oils may be made using a variety of different processes including but not limited to distillation, solvent refining, hydrogen processing, oligomerisation, esterification, and re-refining. For instance, poly alpha-olefins include hydrogenated oligomers of an alpha-olefin, the most important methods of oligomerisation being free radical processes, Ziegler catalysis, and cationic, Friedel-Crafts catalysis.

Certain examples of these types of base oils may be used for the specific properties they possess such as biodegradability, high temperature stability, or non-flammability. In other compositions, other types of base oils may be preferred for reasons of availability or lower cost. Thus, the skilled artisan will recognize that while various types of base oils discussed above may be used in the lubricant compositions, they are not necessarily equivalents of each other in every application.

In one embodiment, the amount of oil of lubricating viscosity can range from about 50 wt % to about 99.98 wt % of the composition. In other embodiments, the amount of oil of lubricating viscosity can range from about 97 wt % to about 99.7 wt %, or from about 98 wt % to about 99.7 wt % of the composition.

The alkylated phenyl-α-naphthyl amine can be described as:

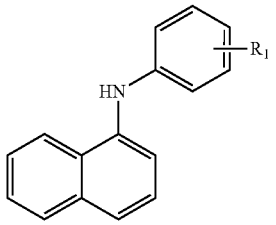

In this embodiment, $R_1$ can be an alkyl group having from about 2 to about 28, from about 4 to about 16, or from about 8 to about 12 carbon atoms.

In one embodiment, the amount of alkylated phenyl-α-naphthyl amine can range from about 0.05 wt % to about 10 wt % of the composition. In other embodiments, the amount alkylated phenyl-α-naphthyl amine can range from about 0.05 wt %, to about 10 wt %, from about 0.05 wt % to about 8 wt %, from about 0.05 wt % to about 7 wt %, from about 0.05 wt % to about 6 wt %, from about 0.05 wt % to about 5 wt %, from about 0.05 wt % to about 4 wt %, from about 0.05 wt % to about 3 wt %, from about 0.05 wt % to about 2 wt %, from about 0.05 wt % to about 1 wt %, from about 0.1 wt % to about 0.7 wt %, or from about 0.2 wt % to about 0.6 wt % of the composition.

Oil soluble triazoles or derivatives thereof are commercially available products that are typically used as metal deactivators and corrosion inhibitors. These materials, which are in solid or liquid form, comprise triazole and derivatives thereof, specifically including but not limited to alkylated benzotriazoles and derivatives such as tolytriazole (also known as tolutriazole or tolyltriazole); 5,5'-methylenebisbenzotriazole; 1-[di(2-ethylhexylaminomethyl)] tolutriazole; and 1-(1-cyclohexyl-oxybutyl)tolutriazole.

In one embodiment, at least one triazole or derivatives thereof comprise a reaction product of a tolyltriazole and an alkylated diphenyl amine. A typical oil soluble diphenylamine tolutriazole reaction product can be represented by formula:

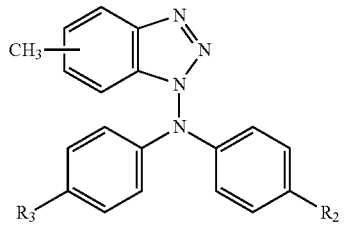

In this embodiment $R_2$ and $R_3$ may be the same or different alkyl groups having from about 3 to about 15 or from about 4 to about 9 carbon atoms.

In some embodiments, at least one triazole or derivatives thereof is blended to provide a concentration of at least about 0.001 wt % based on the weight of either the concentrate or the finished lubricant composition. In some embodiments, the one triazole or derivatives thereof may be blended to provide a concentration of about 0.001 wt % to about 10 wt %. In another embodiment, the one triazole or derivatives thereof may be blended to provide a concentration of about 0.001 wt % to about 8 wt %, from about 0.001 wt % to about 7 wt %, from about 0.001 wt % to about 6 wt %, from about 0.001 wt % to about 5 wt %, from about 0.001 wt % to about 4 wt %, from about 0.001 wt % to about 3 wt %, from about 0.001 wt % to about 2 wt %, from about 0.001 wt % to about 1 wt %, from about 0.001 wt % to about 0.5 wt %, or from about 0.05 wt % to about 0.5 wt % based on the weight of either the concentrate or the finished lubricant composition.

In some embodiments, the finished lubricant composition further comprises at least one additive selected from rust inhibitor, pour point depressant, demulsifier, diluent oil, defoamer, antifoam agents, dispersants, detergents, diluent oil, succinated polyolefins, viscosity modifiers, antistatic agents, antirust agents, extreme pressure/antiwear agents, and seal swell agents, and combinations thereof.

Antirust agents (rust inhibitors) may be a single compound or a mixture of compounds having the property of inhibiting corrosion of ferrous metal surfaces. The rust inhibitors may be used in the range of from about 0.01 wt % to about 3.0 wt % based on the total weight of the composition.

Demulsifiers that may be used include alkyl benzene sulfonates, polyethylene oxides, polypropylene oxides, esters of oil soluble acids and the like. The demulsifiers may be used alone or in combination. Demulsifiers may be present in a range from about 0.001% to about 0.05% by weight, based on the total weight of the composition.

In some embodiments, the additive concentrate will contain at least one diluent, most preferably an aromatic diluent. In a preferred embodiment, it is an oleaginous diluent of suitable viscosity. Such a diluent can be derived from natural or synthetic sources, or blends thereof. Among the mineral (hydrocarbonaceous) oils are paraffin base, naphthenic base, asphaltic base, and mixed base oils. Synthetic oils include polyolefin oils (especially hydrogenated alpha-olefin oligomers), alkylated aromatics, polyalkylene oxides, aromatic ethers, and carboxylate esters (especially diesters), among others. In some embodiments, the aromatic hydrocarbon oils are preferred for use as the diluent.

Typically, the diluent oil generally will have a viscosity in the range from about 1 to about 40 cSt at 100° C., and preferably from about 2 to about 15 cSt at 100° C.

The diluent typically is present within a broad range. In some embodiments, the diluents may be used in the range from about 0.01 wt % to about 2.0 wt % based on the total weight of the composition. In other embodiments, the diluents may be present in a range of from about 5 wt % to about 50 wt %, based on the total weight of the composition.

In other embodiments, the composition can also comprise one or more additives that are conventionally added to lubricating compositions, such as detergents, dispersants, succinated polyolefins, viscosity modifiers, pour point depressants, antistatic agents, antifoams, extreme pressure/antiwear agents, seal swell agents, or mixtures thereof.

Defoamers suitable for use in the embodiments may include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate, polyacrylates, poly dimethyl siloxane, poly ethyl siloxane, polydiethyl siloxane, polymethacrylates, trimethyl-triflouro-propylmethyl siloxane and the like. The antifoams may be used alone or in combination. The antifoams may be used in the range from about 0.001 wt % to about 0.5 wt % based on the total weight of the composition.

The viscosity modifier provides viscosity improving properties. Examples of viscosity modifiers include vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers. The viscosity modifiers may be used in the range from about 0.001 wt % to about 2 wt % based on the total weight of the composition.

The dispersant can include one or more ashless type dispersants such as Mannich dispersants; polymeric dispersants; carboxylic dispersants; amine dispersants, high molecular weight (i.e., at least 12 carbon atoms) esters and the like; esterified maleic anhydride styrene copolymers; maleated ethylene diene monomer copolymers; surfactants; emulsifiers; functionalized derivatives of each component listed herein and the like; and combinations and mixtures thereof. In one embodiment, the preferred dispersant is polyisobutenyl succinimide dispersant. The dispersant may be used in the range from about 0.001 wt % to about 3 wt % based on the total weight of the composition.

The anti-wear agents include sulfur or chlorosulfur compounds, a chlorinated hydrocarbon compound, a phosphorus compound, or mixtures thereof Examples of such agents are amine salts of phosphorus acid, reaction products of alkenes or alkenoic acids with thiophosphoric acids, chlorinated wax, organic sulfides and polysulfides, such as benzyldisulfide, bis-(chlorobenzyl) disulfide, dibutyl tetrasulfide, sulfurized sperm oil, sulfurized methyl ester of oleic acid sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof.

In one embodiment, the antiwear agent comprises an amine salt of a phosphorus ester acid. The amine salt of a phosphorus ester acid includes phosphoric acid esters and salts thereof; dialkyldithiophosphoric acid esters and salts thereof; phosphites; and phosphorus-containing carboxylic esters, ethers, and amides; and mixtures thereof. In one embodiment, the phosphorus compound further comprises a sulfur atom in the molecule. In one embodiment, the amine salt of the phosphorus compound is ashless, i.e., metal-free (prior to being mixed with other components).

The antiwear agent can be used alone or in combination and may be present in an amount from about 0.001 wt % to about 0.5 wt %, based on the total weight of the composition.

The pour point depressants include alkylphenols and derivatives thereof, ethylene vinyl acetate copolymers and the like. The pour point depressant may be used alone or in combination. The pour point depressant may be present in an amount from about 0.01 wt % to about 1.0 wt %, based on the total weight of the composition.

The seal swell agents include organo sulfur compounds such as thiophene, 3-(decyloxy)tetrahydro-1,1-dioxide, phthalates and the like. The seal swell agents may be used alone or in combination. The seal swell agents may be present in an amount from about 0.01 wt % to about 0.5 wt %, based on the total weight of the composition.

The concentrate may be used as is, or may in some embodiments be added to at least one oil of a lubricating viscosity to produce a lubricating oil composition or hydraulic fluid composition. In some embodiments, the concentrate may be used in the final composition at a treat rate from about 0.05 wt % to about 90 wt % to provide the finished composition. The finished lubricant is prepared by mixing or blending the concentrate, and any optional additives, with a suitable base oil of a lubricating viscosity. Preferably, all the additives except for the viscosity modifier and the pour point depressant are blended into a concentrate or additive package, which is subsequently blended into base stock to make finished lubricant. Use of such concentrates is this manner is conventional. The concentrate will typically be formulated to contain the additive(s) in proper amounts to provide the desired concentration in the final formulation when the concentrate is combined with a predetermined amount of base lubricant.

In another embodiment, the composition contains an additive comprising a sheared antifoam solution as described in United States Patent Publication 2017-0065907. This type of sheared antifoam solution can be generally defined by the shearing that is required to produce the sheared antifoam solution with a mean particle size from about 0.01 microns to about 0.5 microns and a maximum particle size of less than about 1 micron. An example of a shear device used to produce the sheared antifoam solution can be a shear mixer within a shear screen wherein the shear screen has a plurality of openings displaced throughout and the openings have at least four straight edges. The sheared antifoam solution may be present in an amount of 0.01 wt % to 1 wt %, based on the total weight of the composition.

The following examples of certain embodiments of the invention are given. Each example is provided by way of explanation of the invention, one of many embodiments of the invention, and the following examples should not be read to limit, or define, the scope of the invention.

Six different composition samples were made using the components listed below in Table 1. The method of production was made by either a blending kettle/tank with a mechanical stirrer or a mechanical pump for mixing. It is also anticipated that the following samples can also be made using an in-line blending system with a static (non-rotation) mixing. The composition may or may not be heated during the production cycle.

TABLE 1

| Amounts in each sample shown by wt % | | | | | | | | |
|---|---|---|---|---|---|---|---|---|
| Sample | A | B | C | D | E | F | G | H |
| 1 | 0.25 | 0.10 | 0.05 | 0.20 | — | 0.03 | 50.0 | 49.6 |
| 2 | 0.50 | 0.10 | 0.05 | 0.20 | — | 0.03 | 50.0 | 49.35 |
| 3 | 0.25 | 0.50 | 0.05 | 0.20 | — | 0.03 | 50.0 | 49.20 |
| 4 | 0.50 | 0.50 | 0.05 | 0.20 | — | 0.03 | 50.0 | 48.95 |
| 5 | 0.25 | 0.10 | 0.05 | 0.20 | 0.02 | 0.04 | 35.0 | 64.34 |
| 6 | 0.50 | 0.10 | 0.05 | 0.20 | 0.02 | 0.04 | 35.0 | 64.09 |

A = alkylated phenyl-α-naphthyl amine
B = oil soluble diphenylamine tolutriazole reaction product
C = Rust Inhibitor
D = Pour Point Depressant
E = Demulsifier
F = Sheared antifoam solution
G = Base Stock A
H = Base Stock B The example composition samples were subjected to several tests including Rotary Pressure Vessel Oxidation Test (RPVOT) in accordance with ASTM D2272 and the Dry-Tost Test in accordance with ASTM D7873. The Dry-TOST procedure was used to oxidize several tubes of each example composition at 120° C. for multiple duration times, a single specimen tube was used for each test duration. Results are reported in Tables 2 through Table 7. A sample of commercially available turbine oil was also tested for comparison purposes and is shown as Sample C1.

Rotary Pressure Vessel Oxidation Test (RPVOT)

RPVOT is a measurement of oxidation induction time and can be used to compare lubricant formulations. In conducting this test, a 50-gram sample is placed into a pressure vessel with five milliliters of deionized water and a copper catalyst. The pressure vessel is then charged with oxygen to 90 psi at room temperature. The assembled pressure vessel is placed into a 150° C. bath and rotated at 100 rpm for the duration of the test. A test is complete with the pressure in the vessel has been reduced by 25.4 psi below the maximum pressure. These values were also used to determine the RPVOT Retention Percentage which is a ratio of the new fluid results to the thermally aged fluid. See Table 2 for the RPVOT results and Table 3 for RPVOT Percent Retention results.

TABLE 2

| | Aging Hours | | | | | | | | | | |
|---|---|---|---|---|---|---|---|---|---|---|---|
| | 0 | 365 | 504 | 672 | 804 | 1008 | 1032 | 1176 | 1344 | 1800 | 2016 |
| Sample 1 | 1730 | 1391 | 1625 | 1643 | 1508 | — | 1049 | 1137 | 902 | — | — |
| Sample 2 | 2394 | 2230 | 2131 | 2022 | 1717 | — | 1443 | 1239 | 1044 | — | — |
| Sample 3 | 1985 | 1586 | 1379 | 1170 | 1516 | — | 1251 | 972 | 852 | — | — |
| Sample 4 | 1968 | 1579 | 1688 | 1374 | 1609 | — | 1336 | 1071 | 825 | — | — |
| Sample 5 | 1887 | 1727 | — | 1531 | — | 1069 | — | — | 620 | 253 | 15 |
| Sample 6 | 2196 | 1859 | — | 1719 | — | 1033 | — | — | 680 | 294 | 16 |
| Sample C1 | 1633 | 625.9 | 525 | 412 | 253 | 189 | — | 96 | 16 | — | — |

TABLE 3

| | Aging Hours | | | | | | | | | | |
|---|---|---|---|---|---|---|---|---|---|---|---|
| | 0 | 365 | 504 | 672 | 804 | 1008 | 1032 | 1176 | 1344 | 1800 | 2016 |
| Sample 1 | 100 | 111.6 | 94.0 | 95.0 | 87.2 | — | 65.8 | 65.8 | 52.1 | — | — |
| Sample 2 | 100 | 93.1 | 89.0 | 84.5 | 71.7 | — | 51.7 | 51.7 | 43.6 | — | — |
| Sample 3 | 100 | 79.9 | 69.5 | 59.0 | 76.4 | — | 49.0 | 49.0 | 42.9 | — | — |
| Sample 4 | 100 | 80.2 | 85.8 | 69.8 | 81.8 | — | 54.4 | 54.4 | 41.9 | — | — |
| Sample 5 | 100 | 91.5 | — | 81.1 | — | 56.7 | — | — | 32.8 | 13.4 | 0.8 |
| Sample 6 | 100 | 84.6 | — | 78.3 | — | 47.0 | — | — | 31.0 | 13.4 | 0.7 |
| Sample C1 | 100 | 36.4 | 31.7 | 24.4 | 16.02 | 11.7 | — | 6.2 | 1.0 | — | — |

Sludge Determination

Sludge measurements were obtained gravimetrically by filtering 100 grams of oil through one micron 47 mm filter. To aid in the filtration a vacuum (100 mmHg) was applied. After passing the sample through the filter it is then rinsed with either filtered hexane or heptane until the solvent appears colorless. Filters are then dried in a 70° C. oven for one hour, allowed to cool then weighted. The sludge values (milligrams) were then used to calculate the amount of sludge generated per kilogram of fluid. See Table 4 for sludge formation results.

TABLE 4

| | Aging Hours | | | | | | | | | | |
|---|---|---|---|---|---|---|---|---|---|---|---|
| | 0 | 365 | 504 | 672 | 804 | 1008 | 1032 | 1176 | 1344 | 1800 | 2016 |
| Sample 1 | 0 | 41.0 | 14.5 | 22.5 | 15.5 | — | 35.5 | 39.5 | 32.0 | — | — |
| Sample 2 | 0 | 40.5 | 19.0 | 17.5 | 48.0 | — | 25.0 | 22.5 | 27.0 | — | — |
| Sample 3 | 0 | 62.0 | 19.5 | 16.0 | 14.5 | — | 26.5 | 18.5 | 39.5 | — | — |
| Sample 4 | 0 | 41.0 | 19.5 | 14.0 | 13.5 | — | 16.5 | 18.5 | 35.0 | — | — |
| Sample 5 | 0 | 62.5 | — | 27.0 | — | 52.5 | — | — | 29.5 | 38.0 | 2701 |
| Sample 6 | 0 | 89.0 | — | 20.0 | — | 25.5 | — | — | 27.0 | 29.0 | 2610.5 |
| Sample C1 | 0 | 31 | 38 | 35.8 | 89.5 | 166.5 | — | 229 | 976.5 | — | — |

Remaining Useful Life Determination (RULER)

RULER is voltammetric method used to determine the amount of hindered phenol's and aromatic amine's antioxidants in new and used lubricating oils by measuring the amount of current flow at a specified voltage producing a voltammogram. The simplest means of reporting the RULER value is to compare a new lubricant sample to the use sample (same lubricant) and report the antioxidant reduction as a percentage remaining over the life of the lubricant. Approximately 0.40 mL of the lubricant to be tested is pipetted into a 7-mL vial containing 5 mL of the test solution and 1 gram of clean sand. The test solution is a proprietary material provided by Fluidtec called Proprietary Green Test Solution and consist of distilled water/acetone (1:10) containing a neutral electrolyte. A current (0 to 1.8V) is applied to the solution at a constant ramp rate (0.1V/s). As the voltage is increased the electro-active species begin to oxidize at the working electrode surface producing a rise in anodic current. See Table 5 for Amine Retention determined by RULER.

TABLE 5

| | Aging Hours | | | | | | | | | | |
|---|---|---|---|---|---|---|---|---|---|---|---|
| | 0 | 365 | 504 | 672 | 804 | 1008 | 1032 | 1176 | 1344 | 1800 | 2016 |
| Sample 1 | 100 | 59.4 | 49.4 | 48.3 | 32.0 | — | 23.3 | 16.0 | 9.4 | — | — |
| Sample 2 | 100 | 62.7 | 48.0 | 42.5 | 22.2 | — | 17.0 | 9.6 | 7.1 | — | — |
| Sample 3 | 100 | 55.7 | 52.8 | 32.8 | 16.2 | — | 16.1 | 12.9 | 5.5 | — | — |
| Sample 4 | 100 | 60.5 | 41.5 | 32.9 | 25.5 | — | 18.5 | 13.6 | 9.7 | — | — |
| Sample 5 | 100 | 57.8 | — | 25.5 | — | 12.7 | — | — | 1.4 | 2.9 | — |
| Sample 6 | 100 | 97.5 | — | 53.6 | — | 13.1 | — | — | 8.5 | 0.8 | — |
| Sample C1 | 100 | 81.1 | 66.7 | 75 | 62.2 | 27.9 | — | 21.6 | 0 | — | — |

Membrane Patch Colorimetery

This test extracts insoluble contaminates (varnish and oxide by-products) that are formed in a lubricant during service onto a 0.45-micron membrane (nitrocellulose) patch. The color of the used filter patch is analyzed by spectrophotometry. The color spectra can be correlated to the amount of oxidation byproducts in the oil or varnish formation potential of the used fluid. Industry has set standard limits to indicate the varnish formation potential: Normal 0 to 15, Monitor 15-30, Abnormal 30 to 40, and Critical>40.

Samples to be tested are incubated at 60° C. to 65° C. for 24 hours, further incubation is done at 15° C. to 25° C. for 72 hours away from UV light (darkened cabinet). A 50-mL aliquot of the sample is mixed 50 mL of petroleum ether and filtered through a 0.45-micron nitrocellulose membrane patch with a vacuum or less than 76 kPA. The membrane is rinsed several times with petroleum ether then allowed to air dry. Color determinations are performed using a handheld spectrophotometer. See Table 6 for Membrane Patch Colorimetry Change.

TABLE 6

| | Aging Hours | | | | | | | | | | |
|---|---|---|---|---|---|---|---|---|---|---|---|
| | 0 | 365 | 504 | 672 | 804 | 1008 | 1032 | 1176 | 1344 | 1800 | 2016 |
| Sample 1 | 1.8 | 26.5 | 17.2 | 25.1 | 29.3 | — | 28.0 | 20.5 | 41.0 | — | — |
| Sample 2 | 3.6 | 26.6 | 25.5 | 29.9 | 17.0 | — | 29.7 | 29.2 | 33.7 | — | — |
| Sample 3 | 1.8 | 22.2 | 23.0 | 23.5 | 18.5 | — | 25.9 | 39.4 | 45.1 | — | — |
| Sample 4 | 6.3 | 24.8 | 21.3 | 21.3 | 23.6 | — | 25.3 | 46.6 | 42.0 | — | — |
| Sample 5 | 1.8 | 39.7 | — | 30.0 | — | 31.0 | — | — | 29.1 | 42.8 | — |
| Sample 6 | 3.6 | 34.2 | — | 28.8 | — | 19.9 | — | — | 23.1 | 38.1 | — |
| Sample C1 | 0.6 | 35.9 | 50.4 | 44.6 | 55.8 | 49.4 | — | 54 | 62 | — | — |

Total Acid Number (TAN)

TAN is used to determine the level of acidic constituents in new lubricants and can be used as a relative indicator of changes that occurred under oxidizing conditions. As the acidic product levels increase the rate of oxidation can increase leading to additive depletion and potential metallic corrosion. See Table 7 for TAN Change.

TABLE 7

| | Aging Hours | | | | | | | | | | |
|---|---|---|---|---|---|---|---|---|---|---|---|
| | 0 | 365 | 504 | 672 | 804 | 1008 | 1032 | 1176 | 1344 | 1800 | 2016 |
| Sample 1 | — | 0.021 | 0.029 | 0.026 | 0.031 | — | 0.029 | 0.030 | 0.034 | — | — |
| Sample 2 | — | 0.040 | 0.042 | 0.042 | 0.046 | — | 0.052 | 0.062 | 0.065 | — | — |
| Sample 3 | — | 0.034 | 0.031 | 0.029 | 0.016 | — | 0.017 | 0.020 | 0.025 | — | — |
| Sample 4 | — | 0.024 | 0.020 | 0.019 | 0.020 | — | 0.022 | 0.033 | 0.034 | — | — |
| Sample 5 | 0.036 | 0.030 | — | 0.028 | — | 0.044 | — | — | 0.050 | 0.071 | 21.52 |
| Sample 6 | 0.031 | 0.018 | — | 0.021 | — | 0.048 | — | — | 0.070 | 0.072 | 17.57 |
| Sample C1 | 0.1 | 0.08 | 0.11 | 0.1 | 0.11 | 0.13 | — | 0.14 | 8.02 | — | — |

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A composition comprising:

a combination of at least two oils of lubricating viscosity selected from API Group II, III, IV or V base stocks and mixtures thereof;

an alkylated phenyl-α-naphthyl amine having an alkyl group from about 8 to about 12 carbon atoms and being present in an amount from about 0.1 wt% to about 0.7 wt%; and at least one oil soluble triazole or derivatives thereof, present in the amount from about 0.05 wt% to about 0.5 wt%, wherein the oil soluble triazole or derivatives thereof comprises at least one oil soluble diphenylamine tolutriazole reaction product, and at least one sheared antifoam solution wherein the sheared antifoam solution has a mean particles size from about 0.01 microns to about 0.5 microns.

2. The composition of claim 1, having a residual RPVOT of 25% after at least 1,000 hours in a Dry TOST test at 120° C.

3. The composition of claim 1, wherein the alkylated phenyl-a-naphthyl amine is present in the range from about 0.2 wt% to about 0.6 wt%.

4. The composition of claim 1, further comprising an additive selected from a rust inhibitor, pour point depressant, demulsifier, diluent oil, defoamer, antifoam agents, dispersants, detergents, diluent oil, succinated polyolefins, viscosity modifiers, antistatic agents, antirust agents, extreme pressure/antiwear agents, and seal swell agents and combinations thereof.

5. The composition of claim 1 having less than 65 mg/Kg of sludge after at least 1,000 hours test duration in a Dry TOST test at 120° C.

6. The composition of claim 1, wherein the composition is used to lubricate a turbine.

* * * * *